US012741774B2

(12) United States Patent
Zhao et al.

(10) Patent No.: US 12,741,774 B2
(45) Date of Patent: Sep. 22, 2026

(54) DEBRIS COLLECTION COMPONENT, DEBRIS COLLECTION ASSEMBLY, AND BATTERY CASE PACKAGING STRUCTURE AND METHOD

(71) Applicant: CONTEMPORARY AMPEREX TECHNOLOGY (HONG KONG) LIMITED, Hong Kong (CN)

(72) Inventors: Pengbo Zhao, Ningde (CN); Yong Wang, Ningde (CN); Zeyu Zheng, Ningde (CN); Li Fu, Ningde (CN); Guangen Wang, Ningde (CN); Wei Zhang, Ningde (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 0 days.

(21) Appl. No.: 19/080,061

(22) Filed: Mar. 14, 2025

(65) Prior Publication Data

US 2025/0214734 A1 Jul. 3, 2025

Related U.S. Application Data

(63) Continuation of application No. PCT/CN2023/095697, filed on May 23, 2023.

(30) Foreign Application Priority Data

Jan. 4, 2023 (CN) ..... 202310007443.2

(51) Int. Cl.
*B65B 55/00* (2006.01)
*B65B 5/06* (2006.01)
(Continued)

(52) U.S. Cl.
CPC ..... *B65B 55/00* (2013.01); *B65B 5/068* (2013.01); *B65B 5/10* (2013.01); *B65B 13/02* (2013.01);
(Continued)

(58) Field of Classification Search
CPC ..... B65B 55/00; B65B 5/068; B65B 5/10; B65B 13/02; B65D 1/34; B65D 21/0212; B65D 71/02
See application file for complete search history.

(56) References Cited

U.S. PATENT DOCUMENTS 10,640,260 B1 5/2020 McAtarian et al.
10,798,884 B1 10/2020 Sweeney
(Continued)

FOREIGN PATENT DOCUMENTS

CN 104058149 A 9/2014
CN 204453129 U 7/2015
(Continued)

OTHER PUBLICATIONS

Chinese Office Action dated Aug. 16, 2025 for application CN 202310007443.2.
(Continued)

*Primary Examiner* — Lucas E. A. Palmer
(74) *Attorney, Agent, or Firm* — Ladas & Parry LLP

(57) ABSTRACT

A debris collection component, a debris collection assembly, a battery case packaging structure and a battery case packaging method are described. The debris collection component is configured to be arranged between two adjacent workpieces stacked in a direction of gravity. The debris collection component comprises a collection tray and a retaining member. The collection tray is configured to receive debris falling from the workpiece above. The retaining member is arranged on the collection tray and configured
(Continued)

to retain the debris. The debris collection component can collect the debris falling from the workpiece above so as to reduce the amount of the debris attached to the workpiece, and reduce the impact of the debris on the subsequent assembly process of the workpiece and the safety performance during the use of the workpiece.

19 Claims, 6 Drawing Sheets

(51) Int. Cl.

| | |
|---|---|
| ***B65B 5/10*** | (2006.01) |
| ***B65B 13/02*** | (2006.01) |
| ***B65D 1/34*** | (2006.01) |
| ***B65D 21/02*** | (2006.01) |
| ***B65D 71/02*** | (2006.01) |

(52) U.S. Cl.
CPC ..... *B65D 1/34* (2013.01); *B65D 21/0212* (2013.01); *B65D 71/02* (2013.01)

(56) References Cited

U.S. PATENT DOCUMENTS

| | | | |
|---|---|---|---|
| 2003/0024844 | A1 | 2/2003 | Hammett |
| 2019/0047742 | A1 | 2/2019 | Wallace |

FOREIGN PATENT DOCUMENTS

| | | | | | |
|---|---|---|---|---|---|
| CN | 204548702 | U | | 8/2015 | |
| CN | 206367713 | U | | 8/2017 | |
| CN | 109911615 | A | | 6/2019 | |
| CN | 210593141 | U | | 5/2020 | |
| CN | 112093161 | A | * | 12/2020 | ..... B08B 5/023 |
| CN | 214453663 | U | | 10/2021 | |
| CN | 113697240 | U | | 11/2021 | |
| CN | 215399965 | U | | 1/2022 | |
| CN | 114476203 | A | * | 5/2022 | ..... B65B 35/22 |
| CN | 114506524 | A | * | 5/2022 | ..... B08B 5/04 |
| CN | 114644144 | A | * | 6/2022 | ..... B65B 55/00 |
| CN | 115319524 | A | | 11/2022 | |
| CN | 220006774 | U | * | 11/2023 | |
| EP | 0995691 | A2 | * | 4/2000 | ..... B65D 71/0096 |
| EP | 1927552 | A2 | * | 6/2008 | ..... B65D 19/0026 |
| EP | 1947020 | A1 | * | 7/2008 | ..... B65D 71/0096 |
| WO | WO-0234640 | A1 | * | 5/2002 | ..... B65D 71/02 |
| WO | 2020165662 | A1 | | 8/2020 | |

OTHER PUBLICATIONS

Second Office Action in Chinese Application No. 202310007443.2, issued on Jan. 13, 2026.
Extended European Search Report in European Application No. 23914202.9, issued on Nov. 17, 2025.
ISR for International Application PCT/CN2023/095697 mailed Sep. 27, 2023.
Written Opinion for International Application PCT/CN2023/095697 mailed Sep. 27, 2023.

* cited by examiner

DEBRIS COLLECTION COMPONENT, DEBRIS COLLECTION ASSEMBLY, AND BATTERY CASE PACKAGING STRUCTURE AND METHOD

CROSS-REFERENCE TO RELATED APPLICATION

The present application is a continuation of International application PCT/CN2023/095697 filed on May 23, 2023 that claims priority to Chinese patent application no. 202310007443.2, filed on Jan. 4, 2023. The subject matter of these applications are incorporated herein by reference in their entirety.

TECHNICAL FIELD

The present application relates to the technical field of packaging of battery cases and in particular to a debris collection component, a debris collection assembly, a battery case packaging structure and a battery case packaging method.

BACKGROUND ART

In recent years, new energy vehicles have developed by leaps and bounds. In the field of electric vehicles, batteries play an irreplaceable and important role as power sources of the electric vehicles, and the range of applications of battery cases is becoming wider and wider. The battery consists of a case and a plurality of battery cells accommodated in the case. As a core component of the new energy vehicle, not only is the battery subject to strict safety requirements, but the packaging structure of the battery case is also an issue of general concern.

SUMMARY OF THE INVENTION

Embodiments of the present application provide a debris collection component, a debris collection assembly, a battery case packaging structure and a battery case packaging method. The debris collection component can collect debris falling from a workpiece above so as to reduce the amount of the debris attached to the workpiece, and reduce the impact of the debris on the subsequent assembly process of the workpiece and the safety performance during the use of the workpiece.

In a first aspect, an embodiment of the present application provides a debris collection component for being arranged between two adjacent workpieces stacked in a direction of gravity, the debris collection component including: a collection tray configured to receive debris falling from the workpiece above; and a retaining member arranged on the collection tray and configured to retain the debris.

In the technical solution described above, the debris collection component is arranged between every two adjacent workpieces stacked in the direction of gravity, and is configured to collect the debris falling from the workpiece above so as to reduce the amount of the debris attached to the workpiece, and reduce the impact of the debris on the subsequent assembly process of the workpiece and the safety performance during the use of the workpiece. In addition, the debris collection component retains the debris in the collection tray by means of the retaining member, which reduces the possibility that the debris in the collection tray is free to move and adheres to the workpiece again during package and transportation of the workpiece.

In some embodiments, the retaining member is arranged on the collection tray in a replaceable manner.

In the technical solution described above, the retaining member is arranged on the collection tray in a replaceable manner, so that the collected debris can be cleaned only by replacing the retaining member, which facilitates recycling of the collection tray.

In some embodiments, the retaining member includes a base plate and a first adhesive layer, the base plate and the collection tray being stacked up, the first adhesive layer being arranged on the side of the base plate facing away from the collection tray, and the first adhesive layer being configured to stick the debris onto the base plate.

In the technical solution described above, after the debris falls onto the retaining member, the retaining member adsorbs the debris by means of the first adhesive layer and retains the debris in the collection tray.

In some embodiments, the retaining member further includes a second adhesive layer, the base plate being bonded to the collection tray by means of the second adhesive layer.

In the technical solution described above, the base plate is bonded to the retaining member by means of the second adhesive layer, achieving a simple bonding structure and facilitating replacement of the retaining member.

In some embodiments, the retaining member is a porous plate or a porous fabric laid on the collection tray.

In the technical solution described above, the retaining member is of a structure having pores, and the debris enters the pores after falling onto the retaining member, so that the debris is retained in the collection tray.

In some embodiments, the porous fabric is a carpet.

In the technical solution described above, the carpet has pores, and the debris enters the pores of the carpet after falling onto the carpet, so that the debris is retained in the collection tray.

In some embodiments, the collection tray includes a bottom wall and a side wall, the side wall being arranged around the bottom wall.

In the technical solution described above, the side wall is arranged around the bottom wall, and the bottom wall and the side wall enclose an accommodating space so as to collect the debris falling from the workpieces above and accommodate the debris in the accommodating space.

In some embodiments, the debris collection component further includes a first support member arranged on the side wall, the first support member being configured to support a further debris collection component stacked above the debris collection component to which the first support member belongs.

In the technical solution described above, the debris collection component supports a further debris collection component above by means of the first support member, so that a plurality of debris collection components can be stacked in a direction of gravity.

In some embodiments, the first support member protrudes from an end of the side wall distal from the bottom wall.

In the technical solution described above, the first support member protrudes from the end of the side wall distal from the bottom wall, which reduces the impact on the internal space of the collection tray, so that the debris above can directly fall into the collection tray.

In some embodiments, the first support member includes a supporting face and a limiting face, the supporting face adjoining and intersecting the limiting face, the supporting face being configured to support the further debris collection component, and the limiting face being configured to limit movement of the further debris collection component in a horizontal plane.

In the technical solution described above, when a plurality of debris collection components are stacked in the direction of gravity, the supporting face is configured to support the debris collection component above, and the limiting face is configured for limiting in a horizontal direction to limit the movement of the debris collection component in the horizontal plane, so that the two debris collection components that are adjacent to each other up and down are kept relatively fixed, and the stability in stacking the debris collection components is improved.

In some embodiments, a plurality of the first support members are provided, the plurality of first support members being distributed at intervals in a circumferential direction of the side wall.

In the technical solution described above, the plurality of first support members are provided to further improve the stability in stacking the debris collection components.

In some embodiments, the workpieces are battery cases.

In the technical solution described above, during packaging and transportation of the battery case, the debris collection component is configured to collect the debris falling from the battery case above, which, in one aspect, reduces the possibility that the debris is scattered on a control console and affects the production progress of a battery; in another aspect, reduces the degree of attachment of the debris onto the battery case, and reduces the possibility that the debris enters the battery to short-circuit the battery, which arouses potential safety hazards.

In a second aspect, an embodiment of the present application provides a debris collection assembly, including a plurality of debris collection components provided in any one of the embodiments in the first aspect, and the plurality of debris collection components can be stacked in a direction of gravity.

In a third aspect, an embodiment of the present application provides a battery case packaging structure, including: a tray; a plurality of battery cases, the plurality of battery cases being stacked on the tray in a direction of gravity, and an opening of each of the battery cases facing downwards; a second support member supported between every two adjacent battery cases; and a debris collection component provided in any one of the embodiments in the first aspect, arranged between every two adjacent battery cases and configured to collect debris falling from the battery case above it.

In the technical solution described above, in one aspect, for a battery cell assembled in an inverted manner, the battery case is inverted such that the process of turning over the battery case is omitted, and the production efficiency is improved. In another aspect, the debris in the battery case is prone to fall in the direction of gravity during packaging and transportation of the battery case, and the debris collection component is arranged between the two adjacent battery cases stacked in the direction of gravity such that the debris falling from above can be received, which reduces the amount of the debris attached into the battery case and further reduces the possibility that the inside of the battery is short-circuited by the debris to arouse potential safety hazards during the use of the battery case.

In some embodiments, a projection of each battery case in the direction of gravity falls within the debris collection component below.

In the technical solution described above, the projection of the battery case in the direction of gravity falls within the debris collection component below, so that the collection tray can receive the debris falling from various positions of the battery case above.

In some embodiments, a gap exists between each of the debris collection components and the battery case above it.

In the technical solution described above, the debris collection component is physically spaced from the battery case to reduce the possibility that the debris in the collection tray is in contact with the battery case above.

In some embodiments, the debris collection component is provided with a clearance opening for bypassing the second support member.

In the technical solution described above, the clearance opening is configured to bypass the second support member so as to reduce the impact on an original supporting position of the second support member.

In some embodiments, the clearance opening is arranged at an edge of the collection tray.

In the technical solution described above, the clearance opening is arranged at the edge of the collection tray, which reduces the impact on the bottom wall of the collection tray, and reduces the possibility that the debris in the collection tray falls out from an opening formed in the bottom wall of the collection tray.

In some embodiments, the battery case packaging structure further includes: a binding member configured to bind the plurality of battery cases.

In the technical solution described above, the binding member is configured to further bind and pack a plurality of battery cases into a whole to facilitate transportation and handling of the battery case.

In a fourth aspect, an embodiment of the present application provides a battery case packaging method, including the following steps: placing one battery case on a tray such that an opening of the battery case faces downwards; placing a second support member and a debris collection component provided in any one of the embodiments in the first aspect on the battery case; placing a further battery case on the second support member such that an opening of the further battery case faces downwards, and supporting the further battery case by means of the second support member; and repeating the previous two steps such that a plurality of battery cases are stacked on the tray in a direction of gravity, and the debris collection component is arranged between every two adjacent battery cases.

In the technical solution described above, the battery case is inverted, which, in one aspect, omits the process of turning over the battery case, and thus improves the production efficiency. In another aspect, it is convenient to clean up the debris attached into the battery case during packaging and transportation, reducing the possibility of potential safety hazards caused by the debris during the use of the battery case.

In some embodiments, after stacking the plurality of battery cases on the tray in the direction of gravity, the method further includes: binding the plurality of battery cases by means of a binding member.

In the technical solution described above, the battery cases are packed by the binding member, which facilitates transportation of the battery cases.

BRIEF DESCRIPTION OF THE DRAWINGS

In order to more clearly describe the technical solutions of embodiments of the present application, the accompanying drawings required in the embodiments will be described briefly below. It should be understood that the following accompanying drawings illustrate only some embodiments of the present application and therefore should not be construed as a limitation on the scope thereof. For those of ordinary skill in the art, other relevant accompanying drawings can also be obtained from these accompanying drawings without any creative effort.

Figure 1:
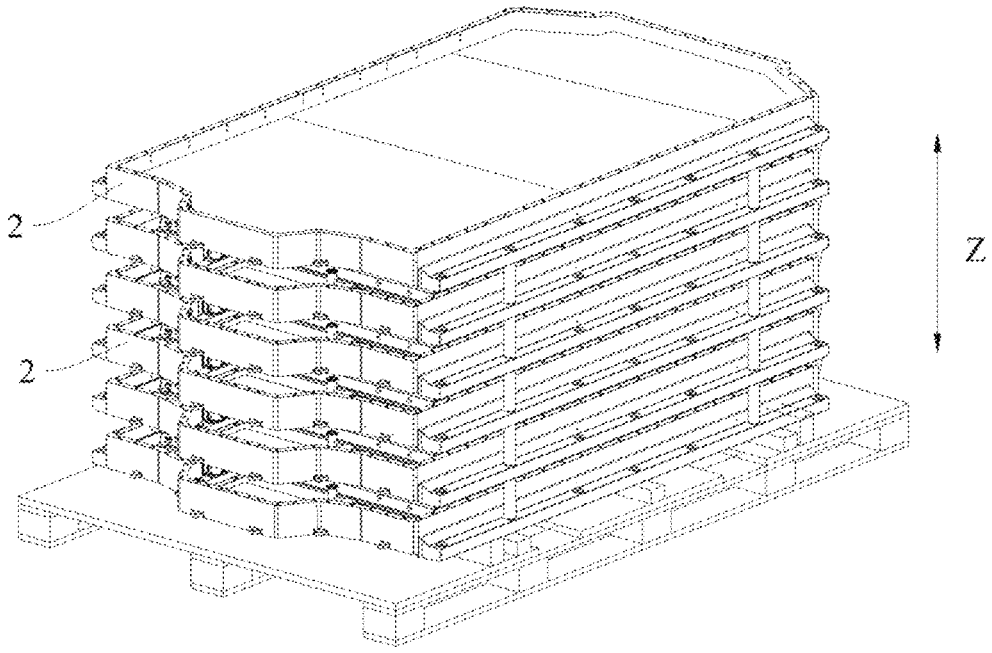
FIG. 1 is a schematic diagram of stacking of general workpieces provided in some embodiments of the present application.

List of reference signs: 10—Debris collection component; 11—Collection tray; 111—Bottom wall; 112—Side wall; 12—Retaining member; 121—Base plate; 122—First adhesive layer; 123—Second adhesive layer; 13—First support member; 131—Supporting face; 132—Limiting face; 14—Clearance opening; 100—Battery case packaging structure; 20—Battery case; 21—Positioning portion; 30—Tray; 40—Second support member; 50—Cushion; 2—Workpiece; Z-Direction of gravity; 1—Debris collection assembly.

DETAILED DESCRIPTION

In order to make the objectives, technical solutions and advantages of embodiments of the present application clearer, the technical solutions in the embodiments of the present application will be described clearly below with reference to the accompanying drawings in the embodiments of the present application. Obviously, the embodiments described are some of, rather than all of, the embodiments of the present application. All other embodiments obtained by those of ordinary skill in the art based on the embodiments of the present application without any creative effort shall fall within the scope of protection of the present application.

Unless otherwise defined, all technical and scientific terms used in the present application have the same meanings as those commonly understood by those skilled in the art to which the present application belongs. The terms used in the description of the present application are merely for the purpose of describing specific embodiments, but are not intended to limit the present application. The terms "comprising" and "having" and any variations thereof in the description and the claims of the present application as well as the brief description of the accompanying drawings described above are intended to cover non-exclusive inclusion. The terms "first", "second", etc. in the description and the claims of the present application as well as the foregoing accompanying drawings are used to distinguish between different objects, rather than describing a specific order or a primary-secondary relationship.

In the present application, the phrase "embodiment" mentioned means that the specific features, structures and characteristics described in conjunction with the embodiments may be included in at least one embodiment of the present application. The phrase at various locations in the description does not necessarily refer to the same embodiment, or an independent or alternative embodiment exclusive of another embodiment.

In the description of the present application, it should be noted that, the terms "mount", "connected", "connect", or "attach" should be interpreted in a broad sense unless explicitly defined and limited otherwise. For example, they may be a fixed connection, a detachable connection, or an integral connection; or may be a direct connection, an indirect connection by means of an intermediate medium, or internal communication between two elements. For those of ordinary skill in the art, the specific meanings of the foregoing terms in the present application may be understood according to specific circumstances.

The term "and/or" in the present application is merely a description of the associated relationship of associated objects, representing that three relationships may exist, for example, A and/or B, may be expressed as: only A exists, both A and B exist, and only B exists. In addition, the character "/" in the present application generally indicates that the associated objects before and after the character are in a relationship of "or".

In the embodiments of the present application, the same reference numerals denote the same components, and for the sake of brevity, the detailed description of the same components is omitted in different embodiments. It should be understood that the dimensions, such as thickness, length and width, of the various components in the embodiments of the present application illustrated in the accompanying drawings, as well as the dimensions, such as an overall thickness, length and width, of an integrated device are merely illustrative and should not be construed to limit the present application in any way.

The phrase "plurality of" appearing in the present application means two or more (including two).

In the present application, a battery cell may include, but is not limited to, a lithium ion secondary battery, a lithium ion primary battery, a lithium-sulfur battery, a sodium-lithium ion battery, a sodium ion battery or a magnesium ion battery, etc. The battery cell may be cylindrical, flat, rectangular, or in another shape. The battery cells are generally classified into three types depending on the way of package: a cylindrical battery cell, a square battery cell, and a soft-packed battery cell.

A battery mentioned in embodiments of the present application refers to a single physical module including one or more battery cells to provide a higher voltage and capacity. For example, the battery mentioned in the present application may include a battery module, a battery pack, etc. The battery generally includes a battery case for packaging one or more battery cells. The battery case can reduce the possibility that liquid or other foreign matter affects charging or discharging of the battery cell(s).

Workpieces are typically stacked directly in a direction of gravity during packaging and transportation, but this packaging method has disadvantages for workpieces to which debris (in particular, metal debris) is attached.

Taking the battery case as an example, because there is a profile structure (for example, aluminum profile) in the battery case, and the profile structure is located in the case, debris (for example, aluminum scraps) inevitably exists in the process of machining the profile structure, and the debris is always attached to the surface of the profile structure or the inside of a cavity. During the use of the battery case, the attached debris is free to move. In order to reduce the possibility of scattering of the free debris, the inner surfaces of the battery cases that are stacked up usually face upwards (i.e., the battery cases are placed upright and openings of the battery cases face upwards).

If the battery case is packaged and transported upright, the debris is attached to the inside of the battery case. In the subsequent assembly process of the battery case, when an operator uses the battery case to accommodate the battery cells, i.e., when the battery is located on a control console and the battery case is turned over to be in an inverted state, it is necessary to cover the battery cells with the battery case from the top of the battery to accommodate the battery cells in the battery case (i.e., the battery case is inverted and the opening of the battery case faces downwards). In the process of turning over the battery case from the upright state to the inverted state, the debris attached to the inside of the battery case is prone to move around and fall onto the control console or the battery cells to be assembled.

The debris scattered on the control console may affect the progress of production and may also affect the assembly of the next battery cell and the battery case. In addition, when the battery case is used for accommodating the battery cells, metal debris (for example, aluminium scraps) that is electrically conductive may easily lead to a series of safety hazards, for example, thermal runaway caused by a short circuit of the battery, during the use of the battery.

In view of this, an embodiment of the present application provides a debris collection component. The debris collection component is placed between two adjacent workpieces stacked in a direction of gravity. During use, a collection tray can receive debris falling from the workpiece above so as to reduce the amount of the debris attached onto the workpiece, reduce the impact of the debris on the subsequent assembly process of the workpiece, and reduce the possibility of potential safety hazards caused by the debris during the use of the workpiece.

The debris collection component provided in the embodiment of the present application may be suitable for, but not limited to, collecting, between two adjacent battery cases stacked in the direction of gravity, the debris falling from the battery case above, and may also be suitable for collecting, between other two adjacent workpieces stacked in the direction of gravity, the debris falling from the workpiece above.

Referring to FIG. 1, FIG. 1 is a schematic diagram of stacking of general workpieces 2 provided in some embodiments of the present application. The workpieces 2 are stacked in a direction of gravity Z. The workpiece 2 inevitably produces debris due to the use of a profile processing material. During packaging and transportation of the workpiece 2, the debris attached to the workpiece 2 is free to move and cannot be collected. The scattered debris may affect the subsequent assembly process of the workpiece 2, and may even arouse potential safety hazards during the use of the workpiece 2.

Figure 2:
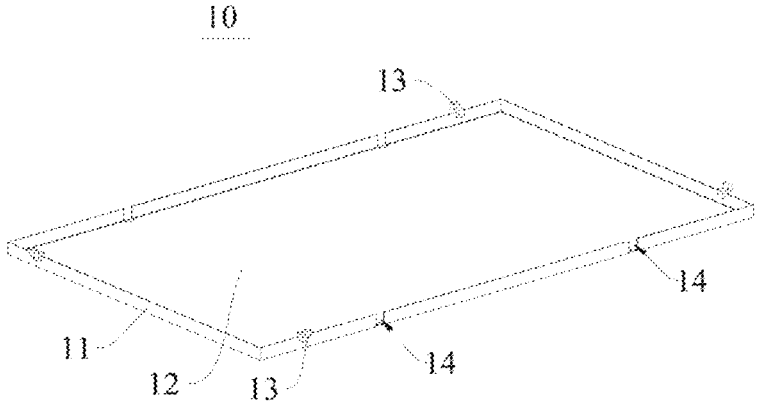
FIG. 2 is a schematic diagram of a debris collection component provided in some embodiments of the present application.
Figure 3:
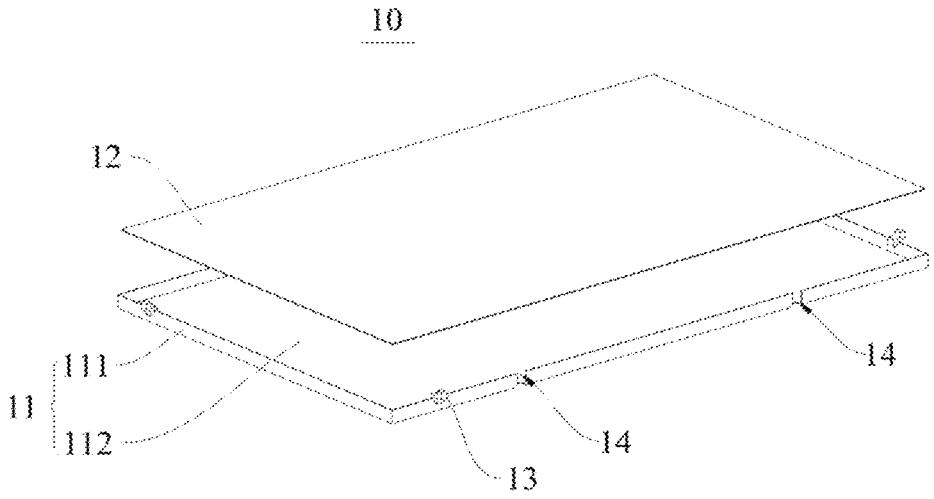
FIG. 3 is an exploded diagram of the debris collection component provided in some embodiments of the present application.

Referring to FIGS. 2 and 3, FIG. 2 is a schematic diagram of a debris collection component 10 provided in some embodiments of the present application; and FIG. 3 is an exploded diagram of the debris collection component 10 provided in some embodiments of the present application. The debris collection component 10 provided in the embodiments of the present application is configured to be arranged between two adjacent workpieces 2 stacked in the direction of gravity Z. The debris collection component 10 includes a collection tray 11 and a retaining member 12. The collection tray 11 is configured to receive debris falling from the workpiece 2 above; and the retaining member 12 is arranged on the collection tray 11, and the retaining member 12 is configured to retain the debris.

The collection tray 11 is a disk-shaped structure capable of collecting and accommodating the debris, and the collection tray 11 may be rectangular, circular, polygonal, etc. The collection tray 11 fits the workpiece 2 in shape to receive the debris falling from the workpiece 2 above.

As an example, in FIG. 2, the workpiece 2 is rectangular, and the collection tray 11 is also rectangular to fit the workpiece 2 in shape.

The retaining member 12 is a component that makes the debris not prone to fall after adsorbing the debris, so that the debris is retained and collected in the collection tray 11, achieving the purpose of collecting the debris.

The retaining member 12 may be rectangular, circular, polygonal, etc. The shape of the retaining member 12 may be the same as or different from that of the collection tray 11. As an example, in FIG. 2, the retaining member 12 is rectangular.

The retaining member 12 may be of a thin sheet structure to reduce the occupancy of the internal accommodating space of the collection tray 11.

In this embodiment, the debris collection component 10 is arranged between the two adjacent workpieces 2 stacked in the direction of gravity Z, and is configured to collect the debris falling from the workpiece 2 above so as to reduce the amount of the debris attached to the workpiece 2, and reduce the impact of the debris on the subsequent assembly process of the workpiece 2 and the safety performance during the use of the workpiece 2.

In addition, the debris collection component 10 retains the debris in the collection tray 11 by means of the retaining member 12, which reduces the possibility that the debris in the collection tray 11 is free to move and is attached to the workpiece 2 during packaging and transportation of the workpiece 2, so that the connection effect of the debris is improved.

In some embodiments, the retaining member 12 is arranged on the collection tray 11 in a replaceable manner.

Understandably, the retaining member 12 may be detached from the collection tray 11. The retaining member 12 may be directly laid in the collection tray 11 and may also be stuck into the collection tray 11, or an accommodating recess may be formed in the collection tray 11 to accommodate the retaining member 12.

In this embodiment, the retaining member 12 is arranged on the collection tray 11 in a replaceable manner, so that the collected debris can be cleaned only by replacing the retaining member 12, which facilitates recycling of the collection tray 11.

Figure 4:
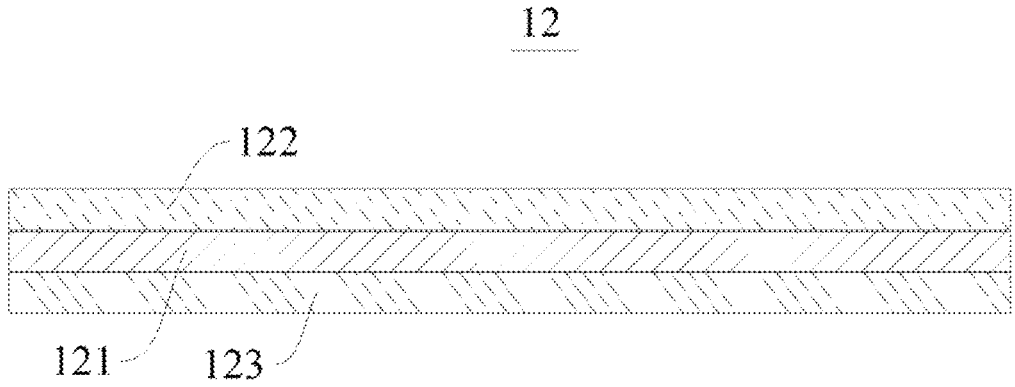
FIG. 4 is a partial schematic diagram of a retaining member provided in some embodiments of the present application.

In some embodiments, referring to FIG. 4, FIG. 4 is a partial schematic diagram of the retaining member 12 provided in some embodiments of the present application. The retaining member 12 includes a base plate 121 and a first adhesive layer 122, the base plate 121 and the collection tray 11 are stacked up, the first adhesive layer 122 is arranged on the side of the base plate 121 facing away from the collection tray 11, and the first adhesive layer 122 is configured to stick the debris onto the base plate 121.

Optionally, the base plate 121 is a metal plate or a plastic plate.

Optionally, the retaining member 12 is an adhesive plate.

In this embodiment, after the debris falls onto the retaining member 12, the retaining member 12 adsorbs the debris by means of the first adhesive layer 122 and retains the debris in the collection tray 11.

In some embodiments, the retaining member 12 further includes a second adhesive layer 123, and the base plate 121 is bonded to the collection tray 11 by means of the second adhesive layer 123.

The second adhesive layer 123 and the first adhesive layer 122 may be made of the same material or different materials. Optionally, the retaining member 12 is a double-sided adhesive, and the first adhesive layer 122 is the same as the second adhesive layer 123.

The retaining member 12 adheres to the collection tray 11, which facilitates replacement of the retaining member 12 in a timely manner as the retaining member 12 adsorbs more and more debris and the adhesive capability becomes weaker. The adhering mode is simple in structure and reduces the production costs.

In some embodiments, optionally, the retaining member 12 is a porous plate or a porous fabric laid on the collection tray 11.

In this embodiment, the retaining member 12 is of a structure having pores, and the debris enters the pores after falling onto the retaining member 12, so that the debris is retained in the collection tray 11.

In some embodiments, the porous fabric is a carpet.

The carpet has pores, and the debris enters the pores of the carpet after falling onto the carpet, so that the debris is retained in the collection tray 11.

In some embodiments, referring to FIG. 3, the collection tray 11 includes a bottom wall 111 and a side wall 112, and the side wall 112 is arranged around the bottom wall 111.

The side wall 112 may be arranged around an edge of the bottom wall 111, or the bottom wall 111 may be arranged close to the edge of the bottom wall 111, at which time there is a certain distance between the side wall 112 and the edge of the bottom wall 111.

The side wall 112 and the bottom wall 111 are non-coplanar, and the side wall 112 may be arranged perpendicular to the bottom wall 111 or form a certain angle with the bottom wall 111.

The side wall 112 is arranged around the bottom wall 111, and the bottom wall 111 and the side wall 112 enclose an accommodating space so as to collect the debris falling from the workpiece 2 above and accommodate the debris in the accommodating space.

Figure 5:
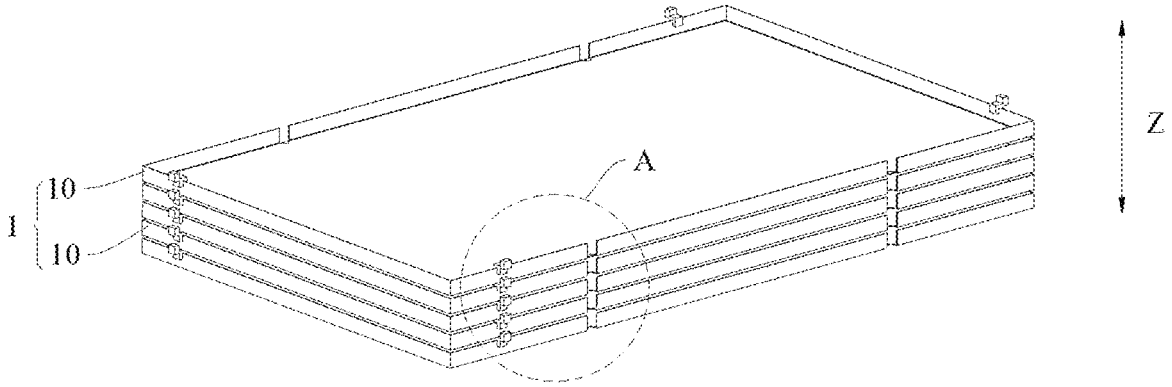
FIG. 5 is a schematic diagram of a debris collection assembly provided in some embodiments of the present application.
Figure 6:
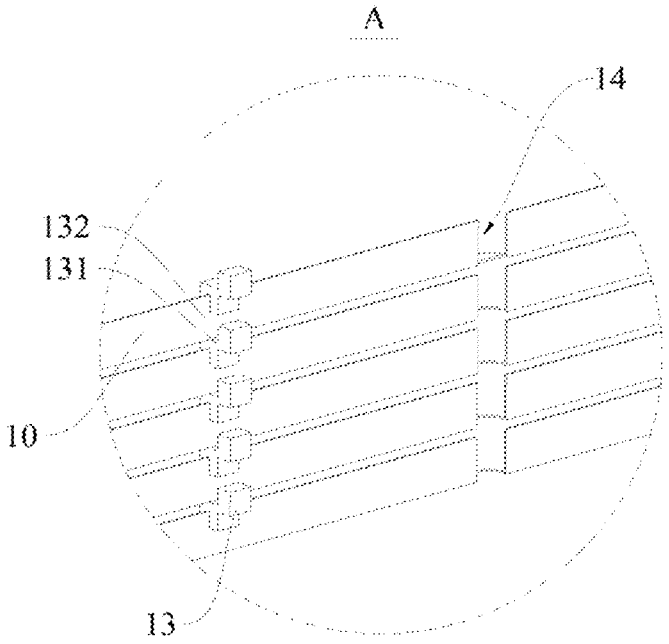
FIG. 6 is an enlarged diagram of a region indicated by A in FIG. 5.

In some embodiments, referring to FIGS. 5 and 6, FIG. 5 is a schematic diagram of the debris collection component 1 provided in some embodiments of the present application; and FIG. 6 is an enlarged diagram of a region indicated by A in FIG. 5. The debris collection component 10 further includes a first support member 13, the first support member 13 is arranged on the side wall 112, and the first support member 13 is configured to support a further debris collection component 10 stacked above the debris collection component 10 to which the first support member 13 belongs.

The support member may be integrated with the side wall 112 and may also be clamped, bonded or welded to the side wall 112.

The debris collection component 10 supports a further debris collection component 10 above by means of the first support member 13, so that the plurality of debris collection components 10 can be stacked in the direction of gravity Z and the occupancy of the floor space is reduced.

In some embodiments, the first support member 13 protrudes from an end of the side wall 112 distal from the bottom wall 111.

The first support member 13 protrudes from the end of the side wall 112 distal from the bottom wall 111. The first support member 13 has a supporting effect while minimizing the impact on the internal space of the collection tray 11 at the same time, avoiding an area where the debris may fall, so that the debris from above can directly fall into the collection tray 11.

In some embodiments, referring to FIG. 6, the first support member 13 includes a supporting face 131 and a limiting face 132. The supporting face 131 adjoins and intersects the limiting face 132. The supporting face 131 is configured to support the further debris collection component 10. The limiting face 132 is configured to limit movement of the further debris collection component 10 in a horizontal plane.

Further, the limiting face 132 and the supporting face 131 may be perpendicular to each other.

Optionally, the supporting face 131 and the limiting face 132 are connected with each other to form a step shape.

In this embodiment, when the plurality of debris collection components 10 are stacked in the direction of gravity Z, the supporting face 131 is configured to support the debris collection component 10 above it, and the limiting face 132 is configured for limiting in a horizontal direction to limit the movement of the debris collection component 10 in the horizontal plane, so that the two debris collection components 10 that are adjacent to each other up and down are kept relatively fixed, and the stability in stacking the debris collection components 10 is improved.

In some embodiments, a plurality of the first support members 13 are provided, and the plurality of first support members 13 are distributed at intervals in a circumferential direction of the side wall 112.

The number of the first support members 13 may be one, two, three, four, five, etc.

As an example, in FIG. 6, there are four first support members 13 respectively arranged on the four side walls 112 of the rectangular collection tray 11.

The plurality of first support members 13 have the same supporting height, and support the debris collection components 10 above at the same height. Therefore, the stability in stacking the debris collection components 10 is further improved.

In some embodiments, the workpieces 2 are battery cases 20.

In this embodiment, during packaging and transportation of the battery case 20, the debris collection component 10 is configured to collect the debris falling from the battery case 20 above so as to reduce the possibility that the debris attached to the battery case 20 above falls into the battery case 20 below.

The debris collection component 10 reduces the amount of debris attached to the battery case 20, which in turn reduces the possibility that the debris is scattered to contaminate the control console and hence affect the subsequent production process of the battery, and also reduces the possibility that the debris enters the battery to short-circuit the battery during the use of the battery case 20, which arouses potential safety hazards.

In some embodiments, an embodiment of the present application further provides a debris collection assembly 1, including a plurality of debris collection components 10 provided in any one of the above embodiments. The plurality of debris collection components 10 may be stacked in a direction of gravity Z.

The number of the debris collection components 10 may be one, two, three, four, five, etc.

As an example, in FIG. 5, five debris collection components 10 are stacked in the direction of gravity Z by means of the first support member 13.

Figure 7:
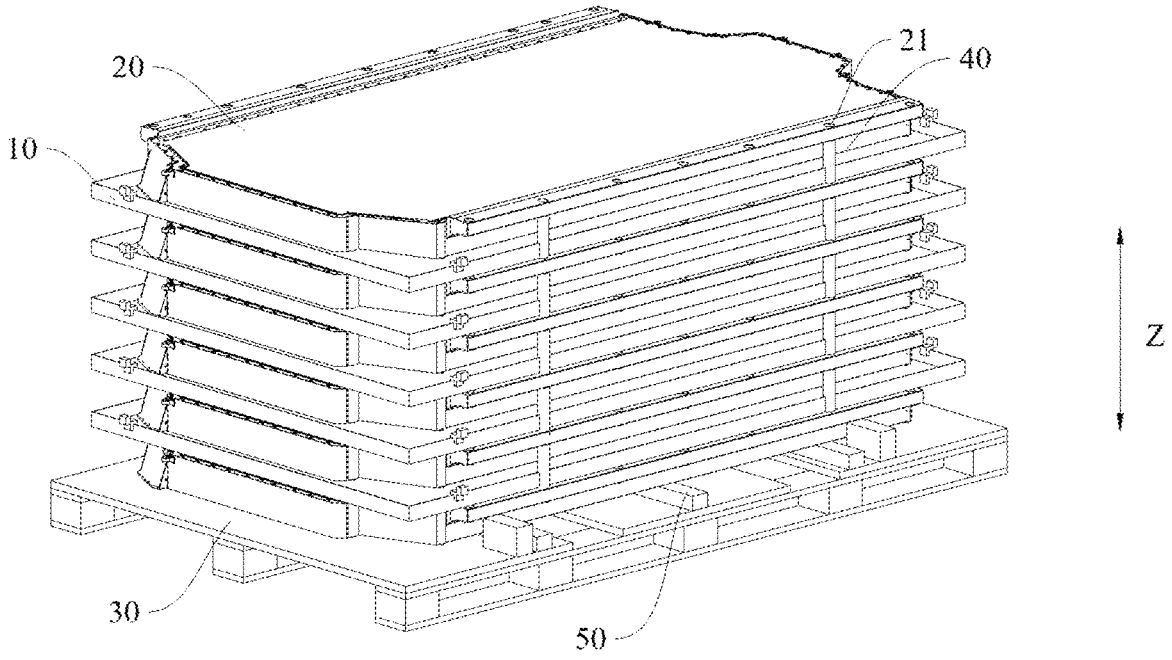
FIG. 7 is a schematic diagram of a battery case packaging structure provided in some embodiments of the present application.
Figure 8:
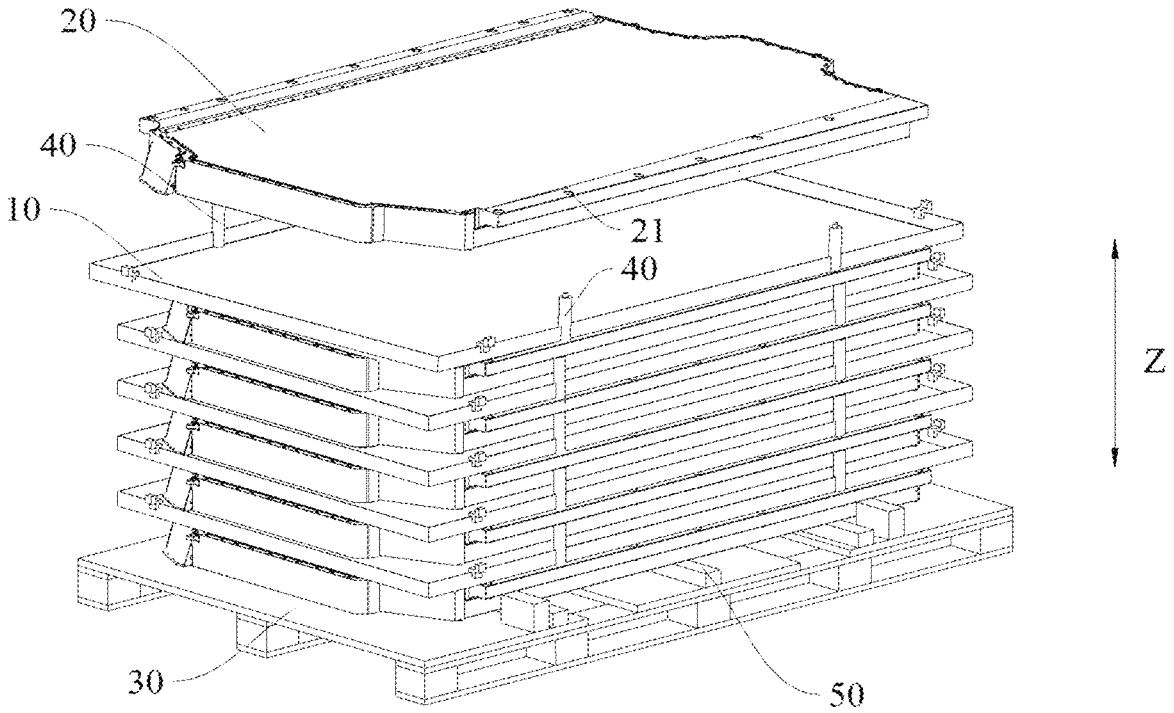
FIG. 8 is a schematic diagram of a battery case packaging process provided in some embodiments of the present application.

In some embodiments, the present application further provides a battery case packaging structure 100. Referring to FIGS. 7 and 8, FIG. 7 is a schematic diagram of a battery case packaging structure 100 provided in some embodiments of the present application; and FIG. 8 is a schematic diagram of a battery case 20 packaging process provided in some embodiments of the present application. The battery case packaging structure 100 includes a tray 30, a battery case 20, a debris collection component 10 provided in any one of the above embodiments, and a second support member 40. The plurality of battery cases 20 are stacked on the tray 30 in a direction of gravity Z, and an opening of each battery case 20 faces downwards; the second support member 40 is supported between every two adjacent battery cases 20; and the debris collection component 10 is arranged between every two adjacent battery cases 20, and the debris collection component 10 is configured to collect debris falling from the battery case 20 above it.

The opening of each battery case 20 faces downwards. It can be understood that each battery case 20 is in an inverted state.

The tray 30 is a platform for placing the battery case 20, may be a control console fixed to the ground, and may also be a movable tray 30 that can be packed and transported with the battery case 20 (as shown in FIG. 7).

In this embodiment, the debris is attached to the battery case 20 (in particular the inside of the battery case 20). For a battery cell that is assembled in an inverted manner, the battery case 20 is inverted. Therefore, in one aspect, the battery case 20 can be used directly, which omits the process of turning over the battery case 20 and improves the production efficiency. In another aspect, the debris in the battery case 20 is prone to fall into the debris collection component 10 in the direction of gravity Z during packaging and transportation of the battery case 20, and the debris collection component 10 collects the debris falling from above so as to reduce the amount of the debris attached into the battery case 20 and further reduce the possibility that potential safety hazards are aroused by a short circuit in the battery caused by the debris during the use of the battery case 20.

Optionally, a plurality of second support members 40 are arranged between every two adjacent battery cases 20, and the plurality of second support members 40 are distributed at intervals at edges of the battery cases 20 so as to reduce the possibility that falling of the debris is affected and collection of the debris by the debris collection component 10 is also affected in the event that the support members are arranged in the middle of the battery cases 20.

Optionally, a first positioning portion 21 is arranged at an edge of the battery case 20. An end portion of the support member is configured to be inserted into the first positioning portion 21 so as to support between two adjacent battery cases 20 and also play a limiting role, which improves the stability in stacking the battery cases 20.

The support member may be cylindrical, and the first positioning portion 21 may be a circular recess.

In some embodiments, the projection of each battery case 20 in the direction of gravity Z falls within the debris collection component 10 below.

Understandably, the projection of the battery case 20 in the direction of gravity Z may be equal to the projection of the debris collection component 10 in the direction of gravity Z, and the projection of the battery case 20 in the direction of gravity Z may also be smaller than the projection of the debris collection component 10 in the direction of gravity Z.

The projection of the battery case 20 in the direction of gravity Z falls within the debris collection component 10 below, which can improve the possibility that the debris falling from all positions of the battery case 20 falls into the debris collection component 10, and reduce the possibility that the debris falls outside the debris collection component 10 and affects the debris collection effect.

In some embodiments, a gap exists between each debris collection component 10 and the battery case 20 above it.

Understandably, the debris collection component 10 is physically spaced from but not in physical contact with the battery case 20, which reduces the possibility that the debris collected in the collection tray 11 is in contact with the battery case 20 above.

Each debris collection component 10 may be in contact with the battery case 20 below. The battery case 20 below is configured to support the debris collection component 10 above. In other words, every two battery cases 20 that are adjacent to each other in the direction of gravity Z are supported by the second support member 40 for being stacked up, and a gap exists between every two adjacent battery cases 20. The debris collection component 10 is placed on the battery case 20 below (i.e., the battery case 20 below supports the debris collection component 10 above), and a gap also exists between the debris collection component 10 and the battery case 20 above.

In some embodiments, referring to FIG. 6, the debris collection component 10 is provided with a clearance opening 14 for bypassing the second support member 40.

The number of the clearance openings 14 corresponds to the number of the second support members 40. For example, there are four second support members 40, and there are also four clearance openings 14.

The number of the clearance openings 14 may also be greater than the number of the second support members 40. For example, there are four second support members 40, and there are six clearance openings 14.

The clearance opening 14 is configured to bypass the second support member 40 so as to reduce the impact of the debris collection component 10 on an original supporting position of the second support member 40.

In some embodiments, the clearance opening 14 is arranged at an edge of the collection tray 11.

The clearance opening 14 may run through both the bottom wall 111 and the side wall 112 of the collection tray 11.

In this embodiment, the clearance opening 14 is arranged at the edge of the collection tray 11 so as to reduce the impact on the middle of the bottom wall 111 of the collection tray 11, and reduce the impact on the debris collection effect when the debris in the collection tray 11 falls out from an opening formed in the middle of the bottom wall 111 of the collection tray 11.

In some embodiments, referring to FIG. 7, with a plurality of stacked battery cases, a cushion 50 is arranged between the lowermost battery case 20 and the tray 30.

The cushion 50 may be made of materials such as foam and rubber.

The cushion 50 provides cushioning between the battery case 20 and the tray 30, thereby reducing the possibility of damages caused by collisions between the lowermost battery case 20 and the tray 30.

In some embodiments, the battery case packaging structure 100 further includes a binding member. The binding member is configured to bind a plurality of battery cases 20. The binding member is configured to further bind and pack a plurality of battery cases 20 into a whole to facilitate transportation and handling of the battery cases 20.

The binding member may be a nylon packing strap.

Figure 9:
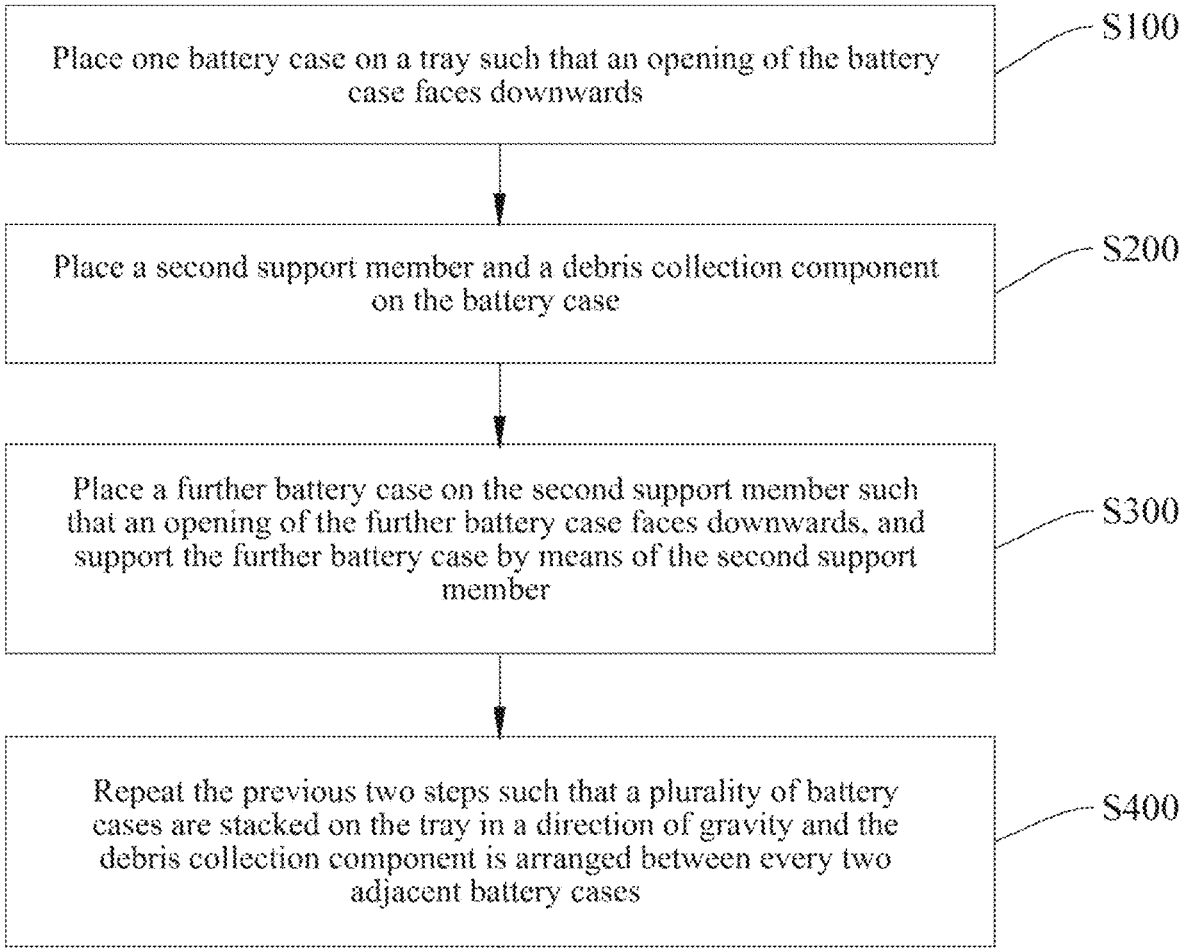
FIG. 9 is a schematic flowchart of a battery case packaging method provided in some embodiments of the present application.

In some embodiments, an embodiment of the present application further provides a battery case 20 packaging method applicable to the battery case packaging structure 100 provided in any one of the above embodiments. Referring to FIG. 9, FIG. 9 is a schematic flowchart of a battery case 20 packaging method provided in some embodiments of the present application. The battery case packaging method includes the following steps.

At step S100, one battery case 20 is placed on a tray 30 such that an opening of the battery case 20 faces downwards.

At step S200, a second support member 40 and a debris collection component 10 provided in any one of the embodiments are placed on the battery case 20.

At step S300, another battery case 20 is placed on the second support member 40 such that an opening of the battery case 20 faces downwards, and the battery case 20 is supported by means of the second support member 40.

At step S400, the previous two steps are repeated such that a plurality of battery cases 20 are stacked on the tray 30 in a direction of gravity Z, and the debris collection component 10 is arranged between every two adjacent battery cases 20.

It should be noted that at step S200, the debris collection component 10 and the second support member 40 are placed in no particular order. For example, one debris collection component 10 may be placed on the battery case 20 first, then the second support member 40 may be inserted at the edge of the battery case 20, and after that, another battery case 20 may be placed on the second support member 40. Alternatively, the second support member 40 may be inserted at the edge of the battery case 20 first, then one debris collection component 10 may be placed on the battery case 20, and after that, a further battery case 20 may be placed on the second support member 40.

Figure 10:
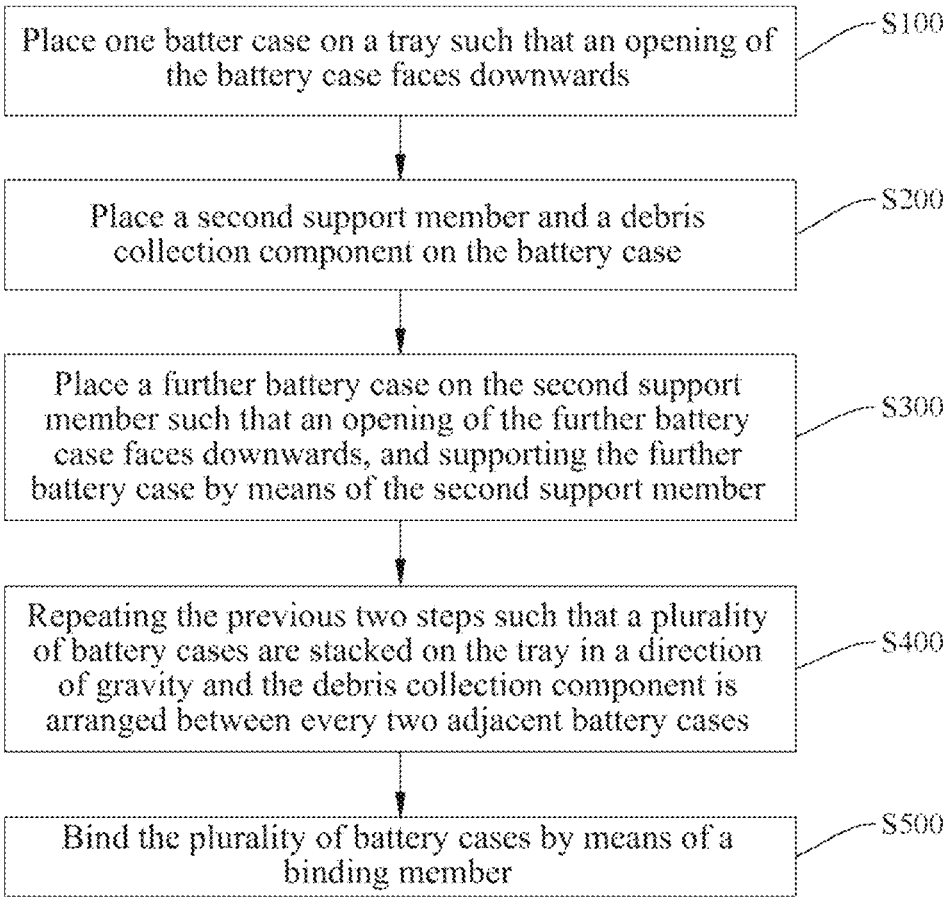
FIG. 10 is a schematic flowchart of a battery case packaging method provided in some other embodiments of the present application.

In some embodiments, a reference may be made to FIG. 10, which is a schematic flowchart of a battery case packaging method provided in some other embodiments of the present application. After the plurality of battery cases 20 are stacked on the tray 30 in the direction of gravity Z, the method further includes the following step.

At step S500, the plurality of battery cases 20 are bound by means of a binding member.

It should be noted that in the case where the tray 30 can be packed together for transportation, the binding member can bind the tray 30 and the battery case 20 together to facilitate stacking of the battery case 20 for transportation. In the case where it is inconvenient to pack the tray 30 and the battery case 20 together for transportation or where it is unnecessary to pack the tray 30, the binding member can bind only the battery case 20 but not the tray 30.

It should be noted that the embodiments in the present application and features in the embodiments may be combined with each other without conflicts.

The above embodiments are only used to explain the technical solutions of the present application, and are not intended to limit the present application, and various modifications and changes of the present application may be made by those skilled in the art. Any modifications, equivalent substitutions, improvements, and the like made within the spirit and principle of the present application should fall within the scope of protection of the present application.

What is claimed is:

1. A debris collection component for being arranged between two adjacent workpieces stacked in a direction of gravity, the debris collection component comprising: a collection tray configured to receive debris falling from the workpiece above; and a retaining member arranged on the collection tray, the retaining member being configured to retain the debris, and wherein the retaining member comprises a base plate and a first adhesive layer, the base plate and the collection tray being stacked up, the first adhesive layer being arranged on the side of the base plate facing away from the collection tray, and the first adhesive layer being configured to stick the debris onto the base plate.

2. The debris collection component according to claim 1, wherein the retaining member is arranged on the collection tray in a replaceable manner.

3. The debris collection component according to claim 1, wherein the retaining member further comprises a second adhesive layer, the base plate being bonded to the collection tray by means of the second adhesive layer.

4. The debris collection component according to claim 1, wherein the retaining member is a porous plate or a porous fabric laid on the collection tray.

5. The debris collection component according to claim 1, wherein the collection tray comprises a bottom wall and a side wall, the side wall being arranged around the bottom wall.

6. The debris collection component according to claim 5, wherein the debris collection component further comprises:

a first support member arranged on the side wall, the first support member being configured to support a further debris collection component stacked above the debris collection component to which the first support member belongs.

7. The debris collection component according to claim 6, wherein the first support member protrudes from the end of the side wall distal from the bottom wall.

8. The debris collection component according to claim 6, wherein the first support member comprises a supporting face and a limiting face, the supporting face adjoining and intersecting the limiting face, the supporting face being configured to support the further debris collection component, and the limiting face being configured to limit movement of the further debris collection component in a horizontal plane.

9. The debris collection component according to claim 6, wherein a plurality of the first support members are provided, the plurality of the first support members being distributed at intervals in a circumferential direction of the side wall.

10. The debris collection component according to claim 1, wherein the workpieces are battery cases.

11. A debris collection assembly, comprising:

a plurality of the debris collection components according to claim 1, the plurality of the debris collection components being stacked in a direction of gravity.

12. A battery case packaging structure, comprising:

a tray;

a plurality of battery cases, the plurality of battery cases being stacked on the tray in a direction of gravity, and an opening of each of the battery cases facing downwards;

a second support member supported between every two adjacent battery cases; and the debris collection component according to claim 1 arranged between every two adjacent battery cases and configured to collect debris falling from the battery case above it.

13. The battery case packaging structure according to claim 12, wherein a projection of each battery case in the direction of gravity falls within the debris collection component below.

14. The battery case packaging structure according to claim 12, wherein a gap exists between each of the debris collection components and the battery case above it.

15. The battery case packaging structure according to claim 12, wherein the debris collection component is provided with a clearance opening for bypassing the second support member.

16. The battery case packaging structure according to claim 15, wherein the clearance opening is arranged at an edge of the collection tray.

17. The battery case packaging structure according to claim 12, wherein the battery case packaging structure further comprises:

a binding member configured to bind the plurality of battery cases.

18. A battery case packaging method, comprising the following steps:

placing one battery case on a tray such that an opening of the battery case faces downwards;

placing a second support member and the debris collection component according to claim 1 on the battery case;

placing a further battery case on the second support member such that an opening of the further battery case faces downwards, and supporting the further battery case by means of the second support member; and repeating the previous two steps such that a plurality of battery cases are stacked on the tray in a direction of gravity, and the debris collection component is arranged between every two adjacent battery cases.

19. The battery case packaging method according to claim 18, wherein after stacking the plurality of battery cases on the tray in the direction of gravity, the method further comprises:

binding the plurality of battery cases by means of a binding member.

* * * * *